US012384981B2

(12) United States Patent
Hogendoorn et al.

(10) Patent No.: US 12,384,981 B2
(45) Date of Patent: Aug. 12, 2025

(54) LUBRICATING OIL COMPOSITION FOR HYBRID VEHICLES

(71) Applicants: CHEVRON ORONITE COMPANY LLC, San Ramon, CA (US); CHEVRON JAPAN LTD., Tokyo (JP)

(72) Inventors: Richard Hogendoorn, Rotterdam (NL); Isao Tanaka, Omaezaki (JP); Jeroen Van Leeuwen, Rotterdam (NL)

(73) Assignees: CHEVRON ORONITE COMPANY LLC, San Ramon, CA (US); CHEVRON JAPAN LTD., Tokyo (JP)

( * ) Notice: Subject to any disclaimer, the term of this patent is extended or adjusted under 35 U.S.C. 154(b) by 0 days.

(21) Appl. No.: 17/761,241

(22) PCT Filed: Sep. 22, 2020

(86) PCT No.: PCT/IB2020/058814

§ 371 (c)(1),
(2) Date: Mar. 17, 2022

(87) PCT Pub. No.: WO2021/059115

PCT Pub. Date: Apr. 1, 2021

(65) Prior Publication Data

US 2022/0380696 A1 Dec. 1, 2022

Related U.S. Application Data

(60) Provisional application No. 62/905,777, filed on Sep. 25, 2019.

(51) Int. Cl.

| | |
|---|---|
| ***C10M 129/10*** | (2006.01) |
| ***C10M 129/42*** | (2006.01) |
| ***C10M 169/04*** | (2006.01) |
| *C10N 30/12* | (2006.01) |
| *C10N 40/25* | (2006.01) |

(52) U.S. Cl.

CPC ..... *C10M 129/10* (2013.01); *C10M 129/42* (2013.01); *C10M 169/04* (2013.01); *C10M 2207/023* (2013.01); *C10M 2207/127* (2013.01); *C10N 2030/12* (2013.01); *C10N 2040/255* (2020.05)

(58) Field of Classification Search

CPC ..... C10M 129/10; C10M 129/42; C10M 169/04; C10M 2207/023; C10M 2207/127; C10N 2030/12; C10N 2040/255

USPC ..... 508/306

See application file for complete search history.

(56) References Cited

U.S. PATENT DOCUMENTS

| | | | | |
|---|---|---|---|---|
| 4,165,292 | A * | 8/1979 | Davis | C10M 141/06 508/270 |
| 5,227,082 | A * | 7/1993 | Pillon | C10M 133/40 252/392 |
| 5,397,487 | A * | 3/1995 | Pillon | C10M 133/06 508/306 |
| 6,043,199 | A * | 3/2000 | Godici | C10M 133/44 508/293 |
| 6,867,171 | B2 * | 3/2005 | Harrison | C07C 57/13 44/418 |
| 2002/0147115 | A1 * | 10/2002 | Harrison | C10M 125/22 508/306 |
| 2004/0121918 | A1 * | 6/2004 | Rea | C10M 169/048 508/438 |
| 2009/0042752 | A1 * | 2/2009 | Waddoups | C10M 141/12 508/435 |
| 2009/0305924 | A1 * | 12/2009 | Mayhew | C10M 129/26 508/306 |
| 2010/0105587 | A1 * | 4/2010 | Okazaki | C10M 169/04 508/306 |
| 2011/0130314 | A1 * | 6/2011 | Andrews | C10M 129/38 508/306 |
| 2011/0239978 | A1 * | 10/2011 | Dambacher | C10M 145/20 508/555 |
| 2018/0201860 | A1 * | 7/2018 | Ransom | F02P 5/02 |

FOREIGN PATENT DOCUMENTS

| | | |
|---|---|---|
| CN | 101372644 | 2/2009 |
| CN | 102498194 | 6/2012 |
| CN | 104583379 | 4/2015 |
| EP | 1512737 | 3/2005 |
| EP | 2031045 | 3/2009 |
| EP | 2374866 | 10/2011 |
| WO | 2014184362 W | 11/2014 |

OTHER PUBLICATIONS

International Search Report, issued on Dec. 9, 2020, during the prosecution of International Application No. PCT/PCT/IB2020/058814.

Written Opinion of the International Searching Authority, issued on Dec. 9, 2020, during the prosecution of International Application No. PCT/IB2020/058814.

Notification of First Office Action, issued on Dec. 8, 2022, during the prosecution of Chinese Application No. 202080067689.3.

Notification of Second Office Action, issued on Jul. 22, 2023, during the prosecution of Chinese Application No. 202080067689.3.

* cited by examiner

*Primary Examiner* — Ellen M McAvoy

(57) ABSTRACT

Disclosed is an internal combustion engine lubricating oil composition for reducing corrosion in the engine of a hybrid vehicle. Reduction of corrosion can be determined by the JIS K2246 test method. Also disclosed are methods for using said lubricating oil composition for reducing corrosion in the engine of a hybrid vehicle.

7 Claims, No Drawings

LUBRICATING OIL COMPOSITION FOR HYBRID VEHICLES

BACKGROUND OF THE DISCLOSURE

Modern lubricating oils are formulated to exacting specifications often set by original equipment manufacturers. To meet the exacting specifications, carefully selected lubricant additives are blended together with base oils of lubricating viscosity. A typical lubricating oil composition may contain, for example, dispersants, detergents, anti-oxidants, wear inhibitors, rust inhibitors, corrosion inhibitors, foam inhibitors, and/or friction modifiers. The specific application or use (e.g., hybrid vehicles) will govern the set of additives that goes into a lubricating oil composition.

Hybrid vehicles rely on two distinctly different types of motive technologies-internal combustion engine and electric motor. The internal combustion engine mainly drives the vehicle at high speeds. The electric motor drives the vehicle at low speeds and can also assist the internal combustion engine when additional power is needed. It is important for hybrid vehicles to distribute power from the engine and the motor in a well-balanced manner as the vehicle speed increases.

Hybrid vehicle typically feature a start-stop system in which the engine stops when the vehicle comes to a stop and the engine fuel system suspends when the vehicle is driven only by motor or braking. Consequently, accumulation of water and fuel in the oil is a problem as the engine is not able to sufficiently evaporate the water and fuel. This results in the formation of unstable emulsions which negatively impacts engine performance and leads to corrosion in engine parts.

The differences between hybrid vehicles and conventional automobile vehicles are significant enough that conventional engine oils are not optimized for use in hybrid vehicles. As a result, lubricating oil compositions designed specifically for hybrid vehicles are needed. In particular, there is a need for lubricating oil compositions that improve corrosion protection of engine parts in hybrid vehicles.

SUMMARY OF THE DISCLOSURE

According to an embodiment, the present invention provides an internal combustion engine lubricating oil composition comprising: (a) a major amount of an oil of lubricating viscosity; (b) one or more compounds containing a carboxylic-acid functional group, ester functional group, or anhydride functional group represented by formula (I) or (II), (I)

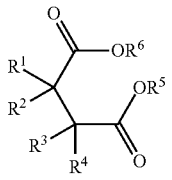

(II)

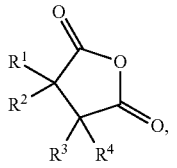

where each $R^1$, $R^2$, $R^3$, and $R^4$ is independently a hydrogen radical, hydrocarbyl radical, or hydrocarbylene radical, where each $R^5$ and $R^6$ is independently a hydrogen radical, hydrocarbyl radical, or hydrocarbylene radical, wherein at least one of $R^1$, $R^2$, $R^3$, and $R^4$ is a hydrocarbyl or hydrocarbylene radical, and (c) a polyalkoxylated hydrocarbyl phenol represented by formula (III) or (IV):

(III)

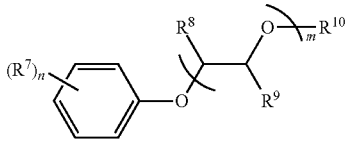

(IV)

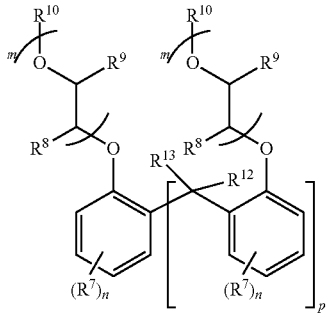

where each $R^7$ is independently a hydrocarbyl or hydrocarbylene radical of 1 to 250 carbon atoms, each $R^8$ and $R^9$ is independently a hydrogen radical, hydrocarbyl radical of 1 to 6 carbon atoms, or hydrocarbylene radical of 1 to 6 carbon atoms; $R^{10}$ is a hydrogen radical, hydrocarbyl radical of 1 to 24 carbon atoms, hydrocarbylene radical of 1 to 24 carbon atoms, or acyl radical represented by —C(═O)$R^{11}$, where $R^{11}$ is a hydrocarbyl or hydrocarbylene radical of 1 to 24 carbon atoms, $R^{12}$ and $R^{13}$ are independently a hydrogen radical, hydrocarbyl radical of 1 to 24 carbon atoms, or hydrocarbylene radical of 1 to 24 carbon atoms, n is 1 to 3, m is 1 to 50, and p is 1 to 50.

According to another embodiment, the present invention provides a method for reducing corrosion in a hybrid engine comprising lubricating and operating a hybrid engine with a lubricating oil composition comprising: (a) a major amount of an oil of lubricating viscosity; (b) one or more compounds containing a carboxylic-acid functional group, ester functional group, or anhydride functional group represented by formula (I) or (II), (I)

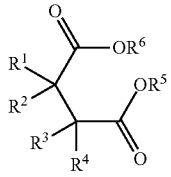

(II)

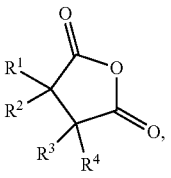

where each $R^1$, $R^2$, $R^3$, and $R^4$ is independently a hydrogen radical, hydrocarbyl radical, or hydrocarbylene radical, each $R^5$ and $R^6$ is independently a hydrogen radical, hydrocarbyl radical, or hydrocarbylene radical, where at least one of $R^1$, $R^2$, $R^3$, and $R^4$ is a hydrocarbyl or hydrocarbylene radical, and (c) a polyalkoxylated hydrocarbyl phenol represented by formula (III) or (IV):

(III)

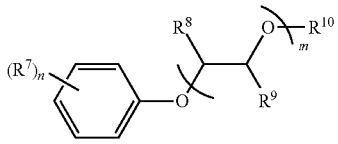

(IV)

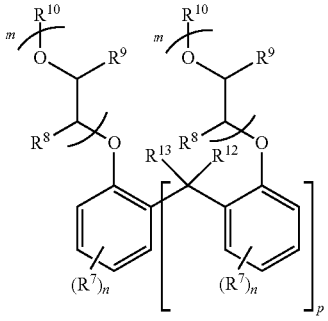

where each $R^7$ is independently a hydrocarbyl or hydrocarbylene radical of 1 to 250 carbon atoms, each $R^8$ and $R^9$ is independently a hydrogen radical, hydrocarbyl radical of 1 to 6 carbon atoms, or hydrocarbylene radical of 1 to 6 carbon atoms; $R^{10}$ is a hydrogen radical, hydrocarbyl radical of 1 to 24 carbon atoms, hydrocarbylene radical of 1 to 24 carbon atoms, or acyl radical represented by —C(═O)$R^{11}$, $R^{11}$ is a hydrocarbyl or hydrocarbylene radical of 1 to 24 carbon atoms, $R^{12}$ and $R^{13}$ are independently a hydrogen radical, hydrocarbyl radical of 1 to 24 carbon atoms, or hydrocarbylene radical of 1 to 24 carbon atoms, n is 1 to 3, m is 1 to 50, and p is 1 to 50.

According to yet another embodiment, the present invention provides a use of a lubricating oil composition comprising: (a) a major amount of an oil of lubricating viscosity; (b) one or more compounds containing a carboxylic-acid functional group, ester functional group, or anhydride functional group represented by formula (I) or (II), (I)

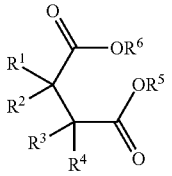

(II)

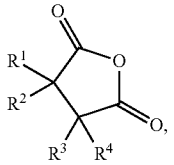

where each $R^1$, $R^2$, $R^3$, and $R^4$ is independently a hydrogen radical, hydrocarbyl radical, or hydrocarbylene radical, each $R^5$ and $R^6$ is independently a hydrogen radical, hydrocarbyl radical, or hydrocarbylene radical, wherein at least one of $R^1$, $R^2$, $R^3$, and $R^4$ is a hydrocarbyl or hydrocarbylene radical, and (c) a polyalkoxylated hydrocarbyl phenol represented by formula (III) or (IV):

(III)

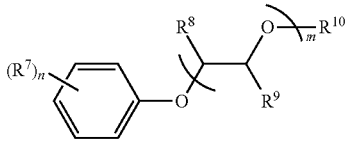

(IV)

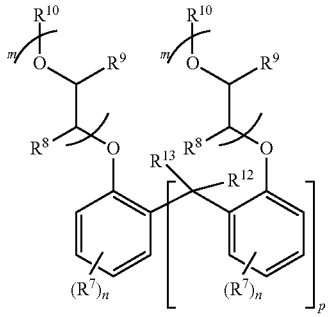

where each $R^7$ is independently a hydrocarbyl or hydrocarbylene radical of 1 to 250 carbon atoms, each $R^8$ and $R^9$ is independently a hydrogen radical, hydrocarbyl radical of 1 to 6 carbon atoms, or hydrocarbylene radical of 1 to 6 carbon atoms; $R^{10}$ is a hydrogen radical, hydrocarbyl radical of 1 to 24 carbon atoms, hydrocarbylene radical of 1 to 24 carbon atoms, or acyl radical represented by —C(═O)$R^{11}$, $R^{11}$ is a hydrocarbyl or hydrocarbylene radical of 1 to 24 carbon atoms, $R^{12}$ and $R^{13}$ are independently a hydrogen radical, hydrocarbyl radical of 1 to 24 carbon atoms, or hydrocarbylene radical of 1 to 24 carbon atoms, n is 1 to 3, m is 1 to 50, and p is 1 to 50, and wherein the lubricating oil composition reduces corrosion in the engine of a hybrid vehicle as determined by the JIS K2246 test method.

DETAILED DISCLOSURE

While the disclosure is susceptible to various modifications and alternative forms, specific embodiments thereof are herein described in detail. It should be understood, however, that the description herein of specific embodiments is not intended to limit the disclosure to the particular forms disclosed, but on the contrary, the intention is to cover all modifications, equivalents, and alternatives falling within the spirit and scope of the disclosure as defined by the appended claims.

To facilitate the understanding of the subject matter disclosed herein, a number of terms, abbreviations or other shorthand as used herein are defined below. Any term, abbreviation or shorthand not defined is understood to have the ordinary meaning used by a skilled artisan contemporaneous with the submission of this application.

Definitions

As used herein, the following terms have the following meanings, unless expressly stated to the contrary.

A "major amount" means in excess of 50 weight % of a composition.

A "minor amount" means less than 50 weight % of a composition, expressed in respect of the stated additive and in respect of the total mass of all the additives present in the composition, reckoned as active ingredient of the additive or additives.

"Active ingredients" or "actives" or "oil free" refers to additive material that is not diluent or solvent.

All percentages reported are weight % on an active ingredient basis (i.e., without regard to carrier or diluent oil) unless otherwise stated.

All ASTM standards referred to herein are the most current versions as of the filing date of the present application.

The present invention provides an internal combustion engine lubricating oil composition comprising:

a. a major amount of an oil of lubricating viscosity;

b. one or more compounds containing a carboxylic-acid functional group, ester functional group, or anhydride functional group represented by formula (I) or (II), (I)

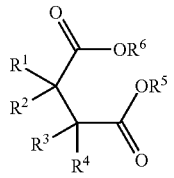

(II)

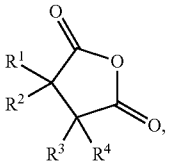

where each $R^1$, $R^2$, $R^3$, and $R^4$ is independently a hydrogen radical, hydrocarbyl radical, or hydrocarbylene radical, each $R^5$ and $R^6$ is independently a hydrogen radical, hydrocarbyl radical, or hydrocarbylene radical, where at least one of $R^1$, $R^2$, $R^3$, and $R^4$ is a hydrocarbyl or hydrocarbylene radical; and c. a polyalkoxylated hydrocarbyl phenol represented by formula (III) or (IV):

(III)

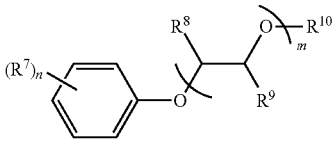

(IV)

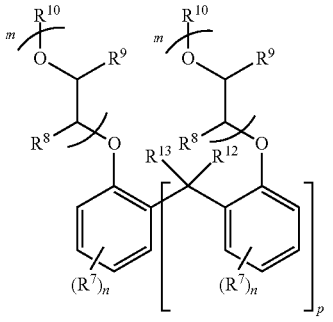

where each $R^7$ is independently a hydrocarbyl or hydrocarbylene radical of 1 to 250 carbon atoms, each $R^8$ and $R^9$ is independently a hydrogen radical, hydrocarbyl radical of 1 to 6 carbon atoms, or hydrocarbylene radical of 1 to 6 carbon atoms; $R^{10}$ is a hydrogen radical, hydrocarbyl radical of 1 to 24 carbon atoms, hydrocarbylene radical of 1 to 24 carbon atoms, or acyl radical represented by —C(=O)$R^{11}$, $R^{11}$ is a hydrocarbyl or hydrocarbylene radical of 1 to 24 carbon atoms, $R^{12}$ and $R^{13}$ are independently a hydrogen radical, hydrocarbyl radical of 1 to 24 carbon atoms, or hydrocarbylene radical of 1 to 24 carbon atoms, where n is 1 to 3, m is 1 to 50, and p is 1 to 50. The lubricating oil composition reduces corrosion in the engine of a hybrid vehicle. Reduction of corrosion can be determined by a modified JIS K2246 method (described in the Examples).

The present invention provides a method for reducing corrosion in a hybrid engine, said method comprising lubricating and operating a hybrid engine with a lubricating oil composition comprising:

a. a major amount of an oil of lubricating viscosity;

b. one or more compounds containing a carboxylic-acid functional group, ester functional group, or anhydride functional group represented by formula (I) or (II), (I)

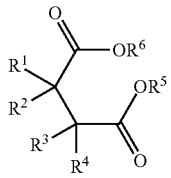

(II)

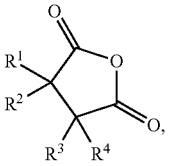

where each $R^1$, $R^2$, $R^3$, and $R^4$ is independently a hydrogen radical, hydrocarbyl radical, or hydrocarbylene radical, each $R^5$ and $R^6$ is independently a hydrogen radical, hydrocarbyl radical, or hydrocarbylene radical, where at least one of $R^1$, $R^2$, $R^3$, and $R^4$ is a hydrocarbyl or hydrocarbylene radical; and c. a polyalkoxylated hydrocarbyl phenol represented by formula (III) or (IV):

(III)

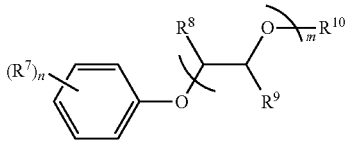

-continued (IV)

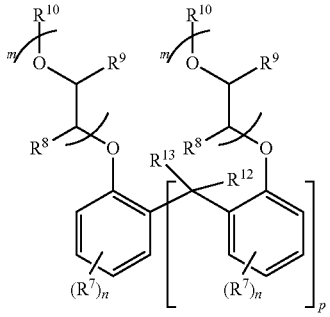

where each $R^7$ is independently a hydrocarbyl or hydrocarbylene radical of 1 to 250 carbon atoms, each $R^8$ and $R^9$ is independently a hydrogen radical, hydrocarbyl radical of 1 to 6 carbon atoms, or hydrocarbylene radical of 1 to 6 carbon atoms; $R^{10}$ is a hydrogen radical, hydrocarbyl radical of 1 to 24 carbon atoms, hydrocarbylene radical of 1 to 24 carbon atoms, or acyl radical represented by —C(═O)$R^{11}$, $R^{11}$ is a hydrocarbyl or hydrocarbylene radical of 1 to 24 carbon atoms, $R^{12}$ and $R^{13}$ are independently a hydrogen radical, hydrocarbyl radical of 1 to 24 carbon atoms, or hydrocarbylene radical of 1 to 24 carbon atoms, n is 1 to 3, m is 1 to 50, and p is 1 to 50. Reduction of corrosion can be determined by the JIS K2246 test as described in the Examples.

Also provided is the use of a lubricating oil composition to lubricate an internal combustion engine comprising:

a. a major amount of an oil of lubricating viscosity;

b. one or more compounds containing a carboxylic-acid functional group, ester functional group, or anhydride functional group represented by formula (I) or (II), (I)

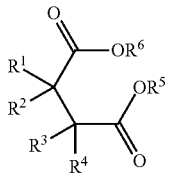

(II)

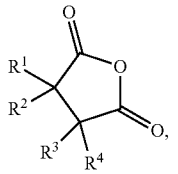

where each $R^1$, $R^2$, $R^3$, and $R^4$ is independently a hydrogen radical, hydrocarbyl radical, or hydrocarbylene radical, each $R^5$ and $R^6$ is independently a hydrogen radical, hydrocarbyl radical, or hydrocarbylene radical, wherein at least one of $R^1$, $R^2$, $R^3$, and $R^4$ is a hydrocarbyl or hydrocarbylene radical; and c. a polyalkoxylated hydrocarbyl phenol represented by formula (III) or (IV):

(III)

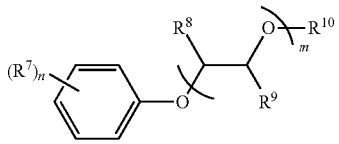

(IV)

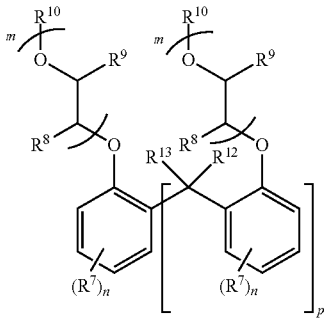

where each $R^7$ is independently a hydrocarbyl or hydrocarbylene radical of 1 to 250 carbon atoms, each $R^8$ and $R^9$ is independently a hydrogen radical, hydrocarbyl radical of 1 to 6 carbon atoms, or hydrocarbylene radical of 1 to 6 carbon atoms; $R^{10}$ is a hydrogen radical, hydrocarbyl radical of 1 to 24 carbon atoms, hydrocarbylene radical of 1 to 24 carbon atoms, or acyl radical represented by —C(═O)$R^{11}$, $R^{11}$ is a hydrocarbyl or hydrocarbylene radical of 1 to 24 carbon atoms, $R^{12}$ and $R^{13}$ are independently a hydrogen radical, hydrocarbyl radical of 1 to 24 carbon atoms, or hydrocarbylene radical of 1 to 24 carbon atoms, n is 1 to 3, m is 1 to 50, and p is 1 to 50, and wherein the lubricating oil composition reduces corrosion in the engine of a hybrid vehicle as determined by the JIS K2246 method.

Oil of Lubricating Viscosity

The oil of lubricating viscosity (sometimes referred to as "base stock" or "base oil") is the primary liquid constituent of a lubricant, into which additives and possibly other oils are blended to produce a final lubricant (or lubricant composition). A base oil is useful for making concentrates as well as for making lubricating oil compositions therefrom and may be selected from natural and synthetic lubricating oils and combinations thereof.

Natural oils include animal and vegetable oils, liquid petroleum oils and hydrorefined, solvent-treated mineral lubricating oils of the paraffinic, naphthenic and mixed paraffinic-naphthenic types. Oils of lubricating viscosity derived from coal or shale are also useful base oils.

Synthetic lubricating oils include hydrocarbon oils such as polymerized and interpolymerized olefins (e.g., polybutylenes, polypropylenes, propylene-isobutylene copolymers, chlorinated polybutylenes, poly(1-hexenes), poly(1-octenes), poly(1-decenes); alkylbenzenes (e.g., dodecylbenzenes, tetradecylbenzenes, dinonylbenzenes, di(2-ethylhexyl)benzenes; polyphenols (e.g., biphenyls, terphenyls, alkylated polyphenols); and alkylated diphenyl ethers and alkylated diphenyl sulfides and the derivatives, analogues and homologues thereof.

Another suitable class of synthetic lubricating oils comprises the esters of dicarboxylic acids (e.g., malonic acid, alkyl malonic acids, alkenyl malonic acids, succinic acid, alkyl succinic acids and alkenyl succinic acids, maleic acid, fumaric acid, azelaic acid, suberic acid, sebacic acid, adipic acid, linoleic acid dimer, phthalic acid) with a variety of alcohols (e.g., butyl alcohol, hexyl alcohol, dodecyl alcohol, 2-ethylhexyl alcohol, ethylene glycol, diethylene glycol monoether, propylene glycol). Specific examples of these esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, and the complex ester formed by reacting one mole of sebacic acid with two moles of tetraethylene glycol and two moles of 2-ethylhexanoic acid.

Esters useful as synthetic oils also include those made from $C_5$ to $C_{12}$ monocarboxylic acids and polyols, and polyol ethers such as neopentyl glycol, trimethylolpropane, pentaerythritol, dipentaerythritol and tripentaerythritol.

The base oil may be derived from Fischer-Tropsch synthesized hydrocarbons. Fischer-Tropsch synthesized hydrocarbons are made from synthesis gas containing H2 and CO using a Fischer-Tropsch catalyst. Such hydrocarbons typically require further processing in order to be useful as the base oil. For example, the hydrocarbons may be hydroisomerized; hydrocracked and hydroisomerized; dewaxed; or hydroisomerized and dewaxed; using processes known to those skilled in the art.

Unrefined, refined and re-refined oils can be used in the present lubricating oil composition. Unrefined oils are those obtained directly from a natural or synthetic source without further purification treatment. For example, a shale oil obtained directly from retorting operations, a petroleum oil obtained directly from distillation or ester oil obtained directly from an esterification process and used without further treatment would be unrefined oil. Refined oils are similar to the unrefined oils except they have been further treated in one or more purification steps to improve one or more properties. Many such purification techniques, such as distillation, solvent extraction, acid or base extraction, filtration and percolation are known to those skilled in the art.

Re-refined oils are obtained by processes similar to those used to obtain refined oils applied to refined oils which have been already used in service. Such re-refined oils are also known as reclaimed or reprocessed oils and often are additionally processed by techniques for approval of spent additive and oil breakdown products.

Hence, the base oil which may be used to make the present lubricating oil composition may be selected from any of the base oils in Groups h-V as specified in the American Petroleum Institute (API) Base Oil Interchangeability Guidelines (API Publication 1509). Such base oil groups are summarized in Table 1 below:

TABLE 1

| | Base Oil Properties | | |
|---|---|---|---|
| Group[a] | Saturates[b], wt. % | Sulfur[c], wt. % | Viscosity Index[d] |
| Group I | <90 and/or | >0.03 | 80 to <120 |
| Group II | ≥90 | ≤0.03 | 80 to <120 |
| Group III | ≥90 | ≤0.03 | ≥120 |
| Group IV | Polyalphaolefins (PAOs) | | |
| Group V | All other base stocks not included in Groups I, II, III or IV | | |

[a]Groups I-III are mineral oil base stocks.
[b]Determined in accordance with ASTM D2007.
[c]Determined in accordance with ASTM D2622, ASTM D3120, ASTM D4294 or ASTM D4927.
[d]Determined in accordance with ASTM D2270.

Base oils suitable for use herein are any of the variety corresponding to API Group II, Group III, Group IV, and Group V oils and combinations thereof, preferably the Group III to Group V oils due to their exceptional volatility, stability, viscometric and cleanliness features.

The oil of lubricating viscosity for use in the lubricating oil compositions of this disclosure, also referred to as a base oil, is typically present in a major amount, e.g., an amount of greater than 50 wt. %, preferably greater than about 70 wt. %, more preferably from about 80 to about 99.5 wt. % and most preferably from about 85 to about 98 wt. %, based on the total weight of the composition. The expression "base oil" as used herein shall be understood to mean a base stock or blend of base stocks which is a lubricant component that is produced by a single manufacturer to the same specifications (independent of feed source or manufacturer's location); that meets the same manufacturers specification; and that is identified by a unique formula, product identification number, or both. The base oil for use herein can be any presently known or later-discovered oil of lubricating viscosity used in formulating lubricating oil compositions for any and all such applications, e.g., engine oils, marine cylinder oils, functional fluids such as hydraulic oils, gear oils, transmission fluids, etc. Additionally, the base oils for use herein can optionally contain viscosity index improvers, e.g., polymeric alkylmethacrylates; olefinic copolymers, e.g., an ethylene-propylene copolymer or a styrene-butadiene copolymer; and the like and mixtures thereof.

As one skilled in the art would readily appreciate, the viscosity of the base oil is dependent upon the application. Accordingly, the viscosity of a base oil for use herein will ordinarily range from about 2 to about 2000 centistokes (cSt) at 100° Centigrade (C.). Generally, individually the base oils used as engine oils will have a kinematic viscosity range at 100° C. of about 2 cSt to about 30 cSt, preferably about 3 cSt to about 16 cSt, and most preferably about 4 cSt to about 12 cSt and will be selected or blended depending on the desired end use and the additives in the finished oil to give the desired grade of engine oil, e.g., a lubricating oil composition having an SAE Viscosity Grade of 0W, 0W-8, 0W-12, 0W-16, 0W-20, 0W-26, 0W-30, 0W-40, 0W-50, 0W-60, 5W, 5W-20, 5W-30, 5W-40, 5W-50, 5W-60, 10W, 10W-20, 10W-30, 10W-40, 10W-50, 15W, 15W-20, 15W-30, 15W-40, 30, 40 and the like.

Carboxylic Acid, Ester, and Anhydride Compound

In one aspect the present disclosure provides one or more compounds containing a carboxylic-acid functional group, ester functional group, or anhydride functional group represented by formula (I) or (II), (I)

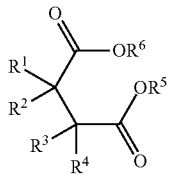

(II)

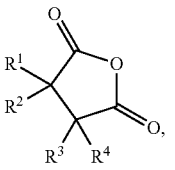

where each $R^1$, $R^2$, $R^3$, and $R^4$ is independently a hydrogen radical, hydrocarbyl radical, or hydrocarbylene radical, each $R^5$ and $R^6$ is a hydrogen radical, hydrocarbyl radical, or hydrocarbylene radical, where at least one of $R^1$, $R^2$, $R^3$, and $R^4$ is a hydrocarbyl or hydrocarbylene radical.

In one embodiment, the hydrocarbyl and hydrocarbylene radicals as described for $R^1$, $R^2$, $R^3$, and $R^4$ can independently be an alkyl or alkylene radical having from 1 to 400 carbon, for example, 1 to 300 carbon atoms, 1 to 200 carbon atoms, 1 to 100 carbon atoms, 1 to 50 carbon atoms, 1 to 30 carbon atoms, or 1 to 25 carbon atoms. For $R^1$, $R^2$, $R^3$, and $R^4$, the alkyl or alkylene radicals include fatty acid moieties (i.e., those derived from fatty acids), or isoaliphatic acid moieties (e.g., those derived from 8-methyloctadecanoic acid). In one embodiment, at least one of $R^1$, $R^2$, $R^3$, and $R^4$ is a dodecenyl radical. In one embodiment, at least one of $R^1$, $R^2$, $R^3$, and $R^4$ is an octadecenyl radical. In one embodiment, at least one of $R^1$, $R^2$, $R^3$, and $R^4$ is a tetrapropenyl radical.

In an embodiment, the hydrocarbyl and hydrocarbylene radicals as described for $R^5$ and $R^6$ can have from 1 to about 30 carbon atoms, for example, from 1 to 25 carbon atoms, from 1 to 20 carbon atom, from 1 to 15 carbon atoms, or from 1 to 10 carbon atoms.

In general, the one or more compounds containing the carboxylic acid, ester, or anhydride can be present in the lubricating oil composition of the present disclosure in an amount ranging from about 0.05 to about 3.0 wt. %, based on the total weight of the lubricating oil composition. In one embodiment, the one or more compounds containing the carboxylic acid, ester, or anhydride can be present in the lubricating oil composition of the present disclosure in an amount ranging from about 0.05 to about 0.75 wt. %, based on the total weight of the lubricating oil composition. In one embodiment, the one or more compounds containing the carboxylic acid, ester, or anhydride can be present in the lubricating oil composition of the present disclosure in an amount ranging from about 0.05 to about 0.50 wt. %, based on the total weight of the lubricating oil composition. In another embodiment, the one or more compounds containing the carboxylic acid, ester, or anhydride can be present in the lubricating oil composition of the present disclosure in an amount ranging from about 0.1 to about 0.30 wt. %, based on the total weight of the lubricating oil composition.

Polyalkoxylated Hydrocarbyl Phenol

In one aspect the present disclosure provides one or more polyalkoxylated hydrocarbyl phenol represented by formula (III) or (IV):

(III)

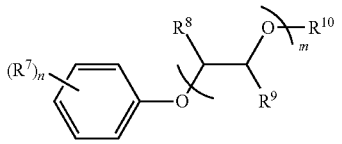

-continued (IV)

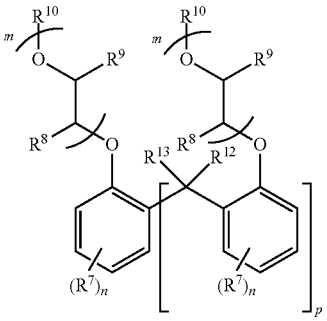

where each $R^7$ is independently a hydrocarbyl or hydrocarbylene radical of 1 to 250 carbon atoms, each $R^8$ and $R^9$ is independently a hydrogen radical, hydrocarbyl radical of 1 to 6 carbon atoms, or hydrocarbylene radical of 1 to 6 carbon atoms: $R^{10}$ is hydrogen radical, hydrocarbyl radical of 1 to 24 carbon atoms, hydrocarbylene radical of 1 to 24 carbon atoms, or acyl radical represented by —C(═O)$R^{11}$, $R^{11}$ is a hydrocarbyl or hydrocarbylene radical of 1 to 24 carbon atoms, $R^{12}$ and $R^{13}$ are independently a hydrogen radical, hydrocarbyl radical of 1 to 24 carbon atoms, or hydrocarbylene radical of 1 to 24 carbon atoms, n is 1 to 3, m is 1 to 50, and p is 1 to 50.

In general, the one or more polyalkoxylated hydrocarbyl phenols can be present in the lubricating oil composition of the present disclosure in an amount ranging from about 0.05 to about 3.0 wt. %, based on the total weight of the lubricating oil composition. In one embodiment, the one or more polyalkoxylated hydrocarbyl phenols can be present in the lubricating oil composition of the present disclosure in an amount ranging from about 0.05 to about 0.75 wt. %, based on the total weight of the lubricating oil composition. In one embodiment, the one or more polyalkoxylated hydrocarbyl phenols can be present in the lubricating oil composition of the present disclosure in an amount ranging from about 0.05 to about 0.50 wt. %, based on the total weight of the lubricating oil composition. In another embodiment, the one or more polyalkoxylated hydrocarbyl phenols can be present in the lubricating oil composition of the present disclosure in an amount ranging from about 0.1 to about 0.30 wt. %, based on the total weight of the lubricating oil composition.

Additional Lubricating Oil Additives

The lubricating oil compositions of the present disclosure may also contain other conventional additives that can impart a desirable property to or improve the lubricating oil composition in which these additives are dispersed or dissolved. Any additive known to a person of ordinary skill in the art may be used in the lubricating oil compositions disclosed herein. Some suitable additives have been described in Mortier et al., "Chemistry and Technology of Lubricants", 2nd Edition, London, Springer, (1996); and Leslie R. Rudnick, "Lubricant Additives: Chemistry and Applications", New York, Marcel Dekker (2003), both of which are incorporated herein by reference. For example, the lubricating oil compositions can be blended with antioxidants, anti-wear agents, detergents such as metal detergents, rust inhibitors, dehazing agents, demulsifying agents, metal deactivating agents, friction modifiers, pour point depressants, antifoaming agents, co-solvents, corrosion-inhibitors, dispersants, multifunctional agents, dyes, extreme pressure agents and the like and mixtures thereof. A variety of the additives are known and commercially available. These additives, or their analogous compounds, can be employed for the preparation of the lubricating oil compositions of the disclosure by the usual blending procedures.

In the preparation of lubricating oil formulations, it is common practice to introduce the additives in the form of 10 to 100 wt. % active ingredient concentrates in hydrocarbon oil, e.g. mineral lubricating oil, or other suitable solvent.

Usually these concentrates may be diluted with 3 to 100, e.g., 5 to 40, parts by weight of lubricating oil per part by weight of the additive package in forming finished lubricants, e.g. crankcase motor oils. The purpose of concentrates, of course, is to make the handling of the various materials less difficult and awkward as well as to facilitate solution or dispersion in the final blend.

Each of the foregoing additives, when used, is used at a functionally effective amount to impart the desired properties to the lubricant. Thus, for example, if an additive is a friction modifier, a functionally effective amount of this friction modifier would be an amount sufficient to impart the desired friction modifying characteristics to the lubricant.

In general, the concentration of each of the additives in the lubricating oil composition, when used, may range from about 0.001 wt. % to about 20 wt. %, from about 0.01 wt. % to about 15 wt. %, or from about 0.1 wt. % to about 10 wt. %, from about 0.005 wt % to about 5 wt. %, or from about 0.1 wt % to about 2.5 wt. %, based on the total weight of the lubricating oil composition. Further, the total amount of the additives in the lubricating oil composition may range from about 0.001 wt. % to about 20 wt %, from about 0.01 wt % to about 10 wt. %, or from about 0.1 wt. % to about 5 wt %, based on the total weight of the lubricating oil composition.

The following examples are presented to exemplify embodiments of the disclosure but are not intended to limit the disclosure to the specific embodiments set forth. Unless indicated to the contrary, all parts and percentages are by weight. All numerical values are approximate. When numerical ranges are given, it should be understood that embodiments outside the stated ranges may still fall within the scope of the disclosure. Specific details described in each example should not be construed as necessary features of the disclosure.

It will be understood that various modifications may be made to the embodiments disclosed herein. Therefore, the above description should not be construed as limiting, but merely as exemplifications of preferred embodiments. For example, the functions described above and implemented as the best mode for operating the present disclosure are for illustration purposes only. Other arrangements and methods may be implemented by those skilled in the art without departing from the scope and spirit of this disclosure. Moreover, those skilled in the art will envision other modifications within the scope and spirit of the claims appended hereto.

EXAMPLES

The following examples are intended for illustrative purposes only and do not limit in any way the scope of the present disclosure.

The lubricating oils were evaluated by the Japanese Industrial Standard (JIS) K2246 test that has been slightly modified for hybrid vehicle lubricants.

JIS K2246 test involves coating test piece sample with test oil and checking for rusting on the test sample. In the modified JIS K2246 test, the test piece sample is coated with a mixture containing test oil and distilled water. Table 2 summarizes the JIS K2246 test results.

The test piece sample is placed in a humidity cabinet above 95% relative humidity (RH) at 49° C. and allowed to stand for 72 hours. The test assesses the ability of oils to prevent rust on metal materials or metal products, mainly consisting of iron and steel. The ASTM D1748 test (Humidity cabinet rust test) is run in a similar fashion. A passing rating is 15 or below.

The mixture containing test oil and distilled water was prepared according to the following steps:

1. Mix 30 ml of distilled water with 270 ml of test oil in a plastic container.
2. Transfer the mixture of test oil and distilled water to a 500 ml container.
3. Stir the mixture containing the test oil and distilled water on the day of the JIS K2246 test followed by 30 seconds handshaking.
4. Heat the test oil in a convection oven at 70° C. for 30 min.
5. After 30 minutes, remove the test oil from oven and allow the test oil to cool down to room temperature.
6. Just prior to soaking the test sample in the test oil, handshake the test oil again for 30 seconds.
7. Start the JIS K2246 test.

Baseline

A lubricating oil composition was prepared that contained a major amount of a group III base oil of lubricating viscosity and the following additives, to provide a finished oil having a 0W-20 viscosity grade:

(1) 250 ppm in terms of boron content, of a borated succinimide dispersant;
(2) 1600 ppm in terms of calcium content of an overbased calcium sulfonate detergent;
(3) 770 ppm in terms of phosphorus content, of approximately at 2:1 mixture of primary to secondary zinc dialkyldithiophosphate;
(4) alkylated diphenylamine antioxidant;
(5) silicon-based foam inhibitor;
(6) olefin copolymer (OCP) viscosity modifier; and
(7) polymethacrylate pour point depressant.

Carboxylic Acid, Ester, Anhydride (Compound A)

Compound A is tetrapropenyl succinic acid.

Polyalkoxylated Hydrocarbylphenol (Compound B)

Compound B is ethoxylated dodecylphenol.

Compound C

Compound C is a thiadiazole with the tradename Hitec® 4313.

Compound D

Compound D is a terephthalic acid salt of a bis-succinimide.

Compound E

Compound E is a secondary alcohol with has been ethoxylated.

Compound F

Compound F is a polypropylene glycol an approximate MW of 2000 g/mol.

Compound G

Compound G is diisodecyl adipate.

Compound H

Compound H is a $C_8$-$C_{10}$ fatty acid ester of trimethylolpropane.

Compound I

Compound I is a dipropylene glycol dibenzoate.

Example 1

To the formulation baseline was added 0.1 wt % of compound A and 0.1 wt % of compound B.

Example 2

To the formulation baseline was added 0.1 wt % of compound A and 0.2 wt % of compound B.

Example 3

To the formulation baseline was added 0.2 wt % of compound A and 0.1 wt % of compound B.

Example 4

To the formulation baseline was added 0.2 wt % of compound A and 0.2 wt % of compound B.

Comparative Example 1

To the formulation baseline was added 0.1 wt. % of compound A.

Comparative Example 2

To the formulation baseline was added 0.2 wt. % of compound A.

Comparative Example 3

To the formulation baseline was added 0.1 wt. % of compound B.

Comparative Example 4

To the formulation baseline was added 0.1 wt. % of compound C and 0.1 wt % of compound B.

Comparative Example 5

To the formulation baseline was added 0.1 wt. % of compound D and 0.1 wt % of compound B.

Comparative Example 6

To the formulation baseline was added 0.1 wt % of compound E and 0.1 wt % of compound B.

Comparative Example 7

To the formulation baseline was added 0.1 wt. % of compound F and 0.1 wt % of compound B.

Comparative Example 8

To the formulation baseline was added 0.1 wt. % of compound G and 0.1 wt % of compound B.

Comparative Example 9

To the formulation baseline was added 0.1 wt. % of compound H and 0.1 wt % of compound B.

Comparative Example 10

To the formulation baseline was added 0.1 wt. % of compound I and 0.1 wt. % of compound B.

TABLE 2

| | JIS K2246* |
|---|---|
| Baseline 1 | 28 |
| Example 1 | 9 |
| Example 2 | 5 |
| Example 3 | 4 |
| Example 4 | 2 |
| Comparative Example 1 | 29 |
| Comparative Example 2 | 15 |
| Comparative Example 3 | 40 |
| Comparative Example 4 | 21 |
| Comparative Example 5 | 33 |
| Comparative Example 6 | 26 |
| Comparative Example 7 | 23 |
| Comparative Example 8 | 27 |
| Comparative Example 9 | 28 |
| Comparative Example 10 | 26 |
| Comparative Example 11 | 25 |

*Average of three runs

All documents described herein are incorporated by reference herein, including any priority documents and/or testing procedures to the extent they are not inconsistent with this text. As is apparent from the foregoing general description and the specific embodiments, while forms of the present disclosure have been illustrated and described, various modifications can be made without departing from the spirit and scope of the present disclosure. Accordingly, it is not intended that the present disclosure be limited thereby.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, within a range includes every point or individual value between its end points even though not explicitly recited. Thus, every point or individual value may serve as its own lower or upper limit combined with any other point or individual value or any other lower or upper limit, to recite a range not explicitly recited.

Likewise, the term "comprising" is considered synonymous with the term "including." Likewise whenever a composition, an element or a group of elements is preceded with the transitional phrase "comprising," it is understood that we also contemplate the same composition or group of elements with transitional phrases "consisting essentially of," "consisting of," "selected from the group of consisting of," or "is" preceding the recitation of the composition, element, or elements and vice versa.

The terms "a" and "the" as used herein are understood to encompass the plural as well as the singular.

Various terms have been defined above. To the extent a term used in a claim is not defined above, it should be given the broadest definition persons in the pertinent art have given that term as reflected in at least one printed publication or issued patent. Furthermore, all patents, test procedures, and other documents cited in this application are fully incorporated by reference to the extent such disclosure is not inconsistent with this application and for all jurisdictions in which such incorporation is permitted.

The foregoing description of the disclosure illustrates and describes the present disclosure. Additionally, the disclosure shows and describes only the preferred embodiments but, as mentioned above, it is to be understood that the disclosure is capable of use in various other combinations, modifications, and environments and is capable of changes or modifications within the scope of the concept as expressed herein, commensurate with the above teachings and/or the skill or knowledge of the relevant art. While the foregoing is directed to embodiments of the present disclosure, other and further embodiments of the disclosure may be devised without departing from the basic scope thereof, and the scope thereof is determined by the claims that follow.

It is understood that when combinations, subsets, groups, etc. of elements are disclosed (e.g., combinations of components in a composition, or combinations of steps in a method), that while specific reference of each of the various individual and collective combinations and permutations of these elements may not be explicitly disclosed, each is specifically contemplated and described herein.

The embodiments described hereinabove are further intended to explain best modes known of practicing it and to enable others skilled in the art to utilize the disclosure in such, or other, embodiments and with the various modifications required by the particular applications or uses. Accordingly, the description is not intended to limit it to the form disclosed herein. Also, it is intended that the appended claims be construed to include alternative embodiments.

The invention claimed is:

1. A method for reducing corrosion and/or rust in a hybrid engine, said method comprising lubricating and operating a hybrid engine with a lubricating oil composition comprising:

a. a major amount of an oil of lubricating viscosity;

b. one or more compounds containing a carboxylic-acid functional group, ester functional group, or anhydride functional group represented by formula (I) or (II), (I)

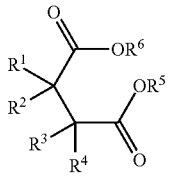

-continued (II)

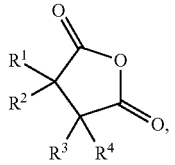

where each $R^1$, $R^2$, $R^3$, and $R^4$ is independently a hydrogen radical, hydrocarbyl radical, or hydrocarbylene radical, each $R^5$ and $R^6$ is independently a hydrogen radical, hydrocarbyl radical, or hydrocarbylene radical, where at least one of $R^1$, $R^2$, $R^3$, and $R^4$ is a hydrocarbyl or hydrocarbylene radical; and c. a polyalkoxylated hydrocarbyl phenol represented by formula (III) or (IV):

(III)

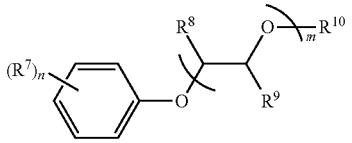

(IV)

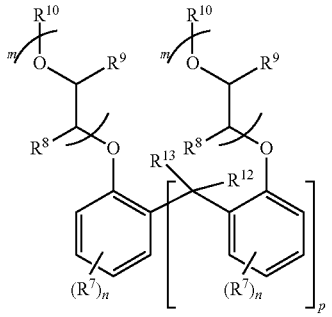

where each $R^7$ is independently a hydrocarbyl or hydrocarbylene radical of 1 to 250 carbon atoms, each $R^8$ and $R^9$ is independently a hydrogen radical, hydrocarbyl radical of 1 to 6 carbon atoms, or hydrocarbylene radical of 1 to 6 carbon atoms; $R^{10}$ is a hydrogen radical, hydrocarbyl radical of 1 to 24 carbon atoms, hydrocarbylene radical of 1 to 24 carbon atoms, or acyl radical represented by —C(═O)$R^{11}$, $R^{11}$ is a hydrocarbyl or hydrocarbylene radical of 1 to 24 carbon atoms, $R^{12}$ and $R^{13}$ are independently a hydrogen radical, hydrocarbyl radical of 1 to 24 carbon atoms, or hydrocarbylene radical of 1 to 24 carbon atoms, n is 1 to 3, m is 1 to 50, and p is 1 to 50.

2. The method of claim 1, wherein the lubricating oil reduces corrosion in the engine of a hybrid vehicle as determined by JIS K2246 test, wherein the JIS K2246 measures rusting a metal piece in a test fluid.

3. The method of claim 2, wherein the test fluid includes water.

4. The method of claim 3, wherein the test fluid includes about 10% by volume of water.

5. The method of claim 1, wherein the lubricating oil further comprises antioxidant, anti-wear agent, detergent, rust inhibitor, dehazing agent, demulsifying agent, metal deactivating agent, friction modifier, pour point depressant, antifoaming agent, co-solvent, corrosion-inhibitor, dispersant, multifunctional agent, dye, or extreme pressure agent.

6. The method of claim 1, wherein the one or more compounds containing a carboxylic-acid functional group, ester functional group, or anhydride functional group is present in an amount ranging from about 0.05 to about 3.0 wt % based on total weight of the lubricating oil composition.

7. The method of claim 1, wherein the polyalkoxylated hydrocarbyl phenol is present in an amount ranging from about 0.05 to about 3.0 wt % based on total weight of the lubricating oil composition.

* * * * *